US008702525B2

(12) United States Patent
Bradley et al.

(10) Patent No.: US 8,702,525 B2
(45) Date of Patent: Apr. 22, 2014

(54) FLUME WITHIN A FLUME

(75) Inventors: Bruce R. Bradley, Vancouver (CA); Timothy B. Kwasnicki, Delta (CA); Daniel P. Brassard, Vancouver (CA); Hyuma Frankowski, Vancouver (CA)

(73) Assignee: Whitewater West Industries Ltd. (CA)

( * ) Notice: Subject to any disclaimer, the term of this patent is extended or adjusted under 35 U.S.C. 154(b) by 182 days.

(21) Appl. No.: 13/111,852

(22) Filed: May 19, 2011

(65) Prior Publication Data

US 2011/0287848 A1 Nov. 24, 2011

Related U.S. Application Data

(60) Provisional application No. 61/347,332, filed on May 21, 2010.

(51) Int. Cl.
*A63G 21/18* (2006.01)
*A63G 21/00* (2006.01)

(52) U.S. Cl.
USPC ..... 472/117; 472/128

(58) Field of Classification Search
USPC ..... 472/13, 116, 117, 128, 129; 104/69, 70
See application file for complete search history.

(56) References Cited

U.S. PATENT DOCUMENTS

| | | | | |
|---|---|---|---|---|
| 4,821,647 | A * | 4/1989 | Powell et al. | 104/23.2 |
| 6,527,646 | B1 * | 3/2003 | Briggs | 472/117 |
| 7,048,092 | B2 * | 5/2006 | Gomes Junior | 182/48 |
| 2007/0167246 | A1 * | 7/2007 | McKee et al. | 472/116 |

* cited by examiner

*Primary Examiner* — Kien Nguyen
(74) *Attorney, Agent, or Firm* — Greenberg Traurig, LLP; Joseph Tache

(57) ABSTRACT

The present invention relates to an interactive ride, such as a flume within a flume. In one embodiment, a water ride can include a first flume ride and a second flume ride. The first flume ride can include a first middle section, while the second flume ride can include a second flume section. The second flume ride can pass through the first flume ride by having the second middle section pass through the first middle section. Thus, the second middle section can be located within the first middle section. The first middle section and the second middle section can form a pass-through section. The second flume ride can be partially supported by the first flume ride.

23 Claims, 9 Drawing Sheets

FLUME WITHIN A FLUME

CROSS-REFERENCE TO RELATED APPLICATIONS

This application claims the benefit of U.S. Provisional Patent Application Ser. No. 61/347,332, filed on May 21, 2010, entitled "FLUME WITHIN A FLUME," which is hereby incorporated by reference in its entirety.

BACKGROUND OF THE INVENTION

1. Field of the Invention

The present invention relates to a method and system for a water ride attraction having multiple flume rides in which one or more flumes rides pass within another flume ride.

2. Description of the Related Art

Conventional flume rides involve a user sliding down a flume, usually with the aid of water. However, as flume rides have evolved, users have demanded more sensory stimulation. In response, water ride manufacturers have added flumes with twists and turns, or which soar high in the air to allow an aerial view of the water park. However, users still demand greater thrills, stimulation, and interaction. Notably humans have a desire to interact with each other. Unfortunately conventional flume rides allow little interaction between users. Thus, there is a need for a more interactive ride, such as a flume within a flume.

BRIEF SUMMARY OF THE INVENTION

The present invention relates to an interactive ride, such as a flume within a flume. In one embodiment, a water ride can include a first flume ride and a second flume ride. The first flume ride can include a first middle section, while the second flume ride can include a second flume section. The second flume ride can pass through the first flume ride by having the second middle section pass through the first middle section. That is, the second middle section can be located within the first middle section. The first middle section and the second middle section can form a pass-through section.

This can allow, for example, for users in the first flume ride and the users in the second flume ride to pass near each other, allowing for an interactive experience. The users in the second flume section can see, for example, the users in the first flume ride passing by below them. Furthermore in some embodiments, the first flume ride and/or the second flume ride can be formed completely or partially from substantially transparent material. This can allow greater interaction between the users of the first flume ride and the users of the second flume ride as the users from each of the flume rides may be able to see each other.

In other embodiments, the first flume ride can be formed from an opaque material to simulate the appearance of a dark channel or cave. This can heighten the user senses such that when the users from the first flume and the users from the second flume pass by each other, additional excitement is felt by the users from the first flume and/or the users form the second flume.

In one embodiment, the present invention is a water ride attraction including a first flume ride, and a second flume ride, wherein the second flume ride passes through the first flume ride at a pass-through section, and the second flume ride is located within the first flume ride at the pass-through section.

In another embodiment, the present invention is a water ride attraction including a first flume ride including a first middle section, and a second flume ride including a second middle section located within the first middle section, wherein the first middle section and the second middle section form a pass-through section, and the second flume ride passes through the first flume ride at the pass-through section.

In yet another embodiment, the present invention is a water ride attraction including a first flume ride including a first middle section formed from a substantially transparent material, the first middle section having a ring section and support units, wherein the ring section and the support units cooperate to support the first middle section, and a second flume ride including a second middle section formed from the substantially transparent material, and located within the first middle section, wherein the first middle section and the second middle section form a pass-through section, and the second flume ride passes through the first flume ride at the pass-through section.

BRIEF DESCRIPTION OF THE DRAWINGS

The features, objects, and advantages of the present invention will become more apparent from the detailed description set forth below when taken in conjunction with the drawings, wherein.

DETAILED DESCRIPTION OF THE INVENTION

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 2:
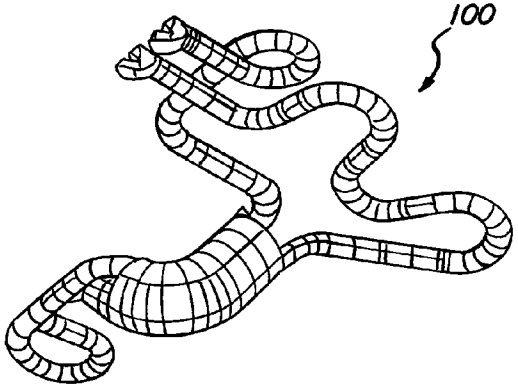
FIG. 2 is a schematic diagram of a water ride attraction according to an embodiment of the present invention.
Figure 1:
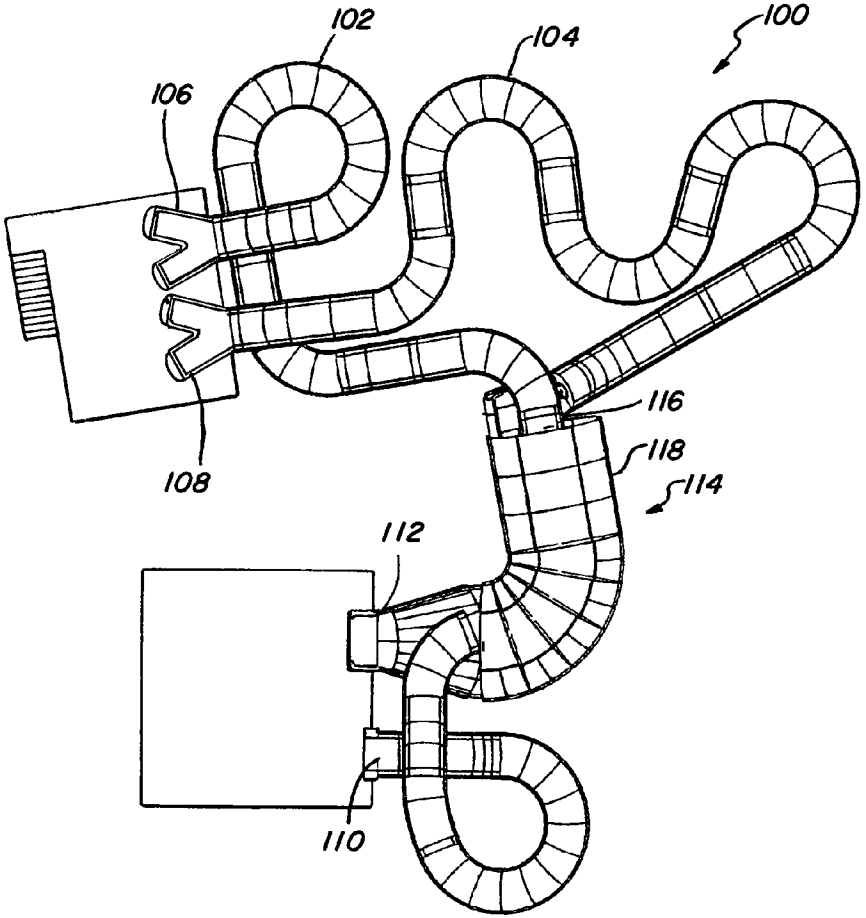
FIG. 1 is a schematic diagram of a water ride attraction according to an embodiment of the present invention.
Figure 3:
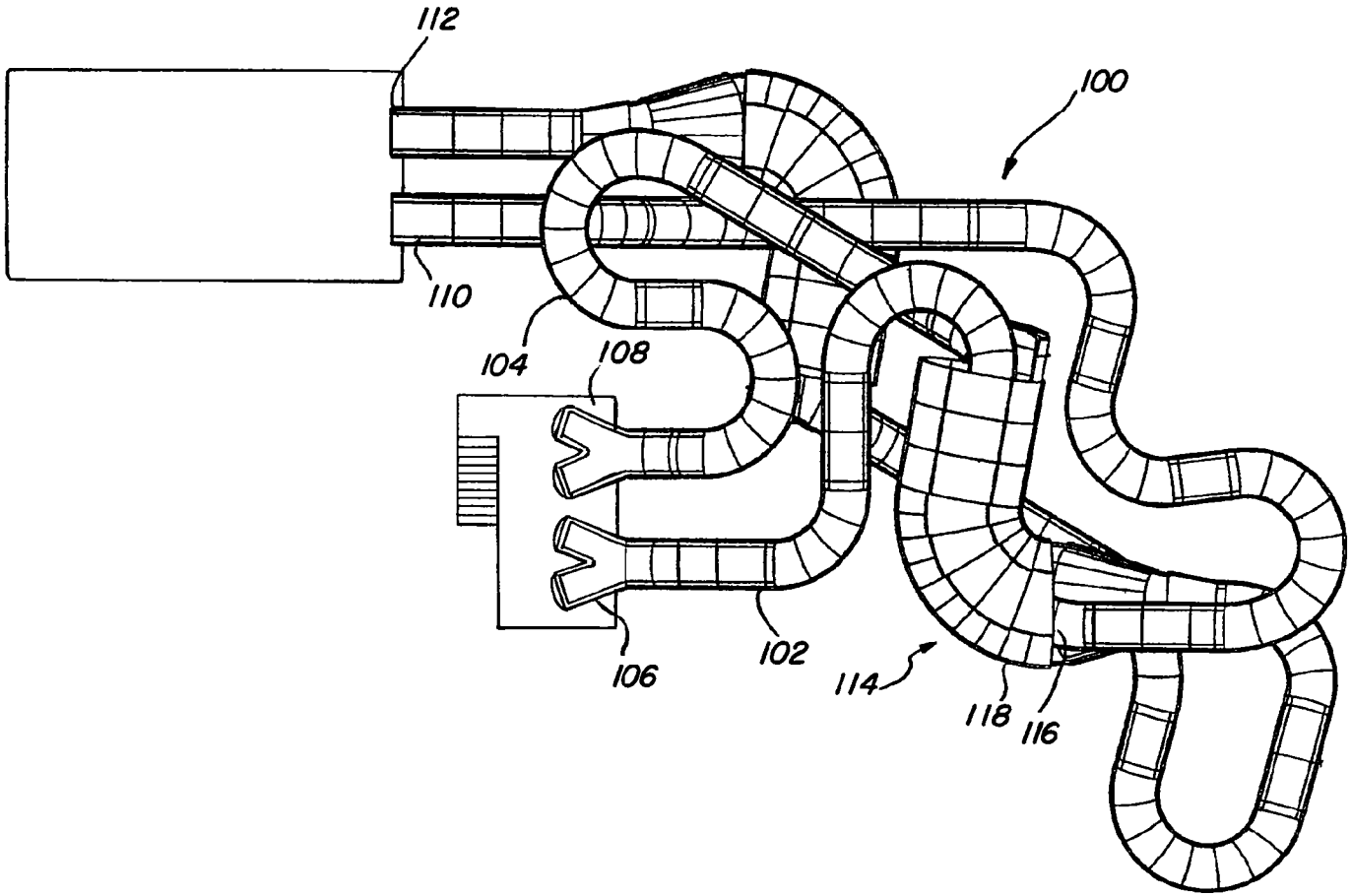
FIG. 3 is a schematic diagram of a water ride attraction according to an embodiment of the present invention.
Figure 4:
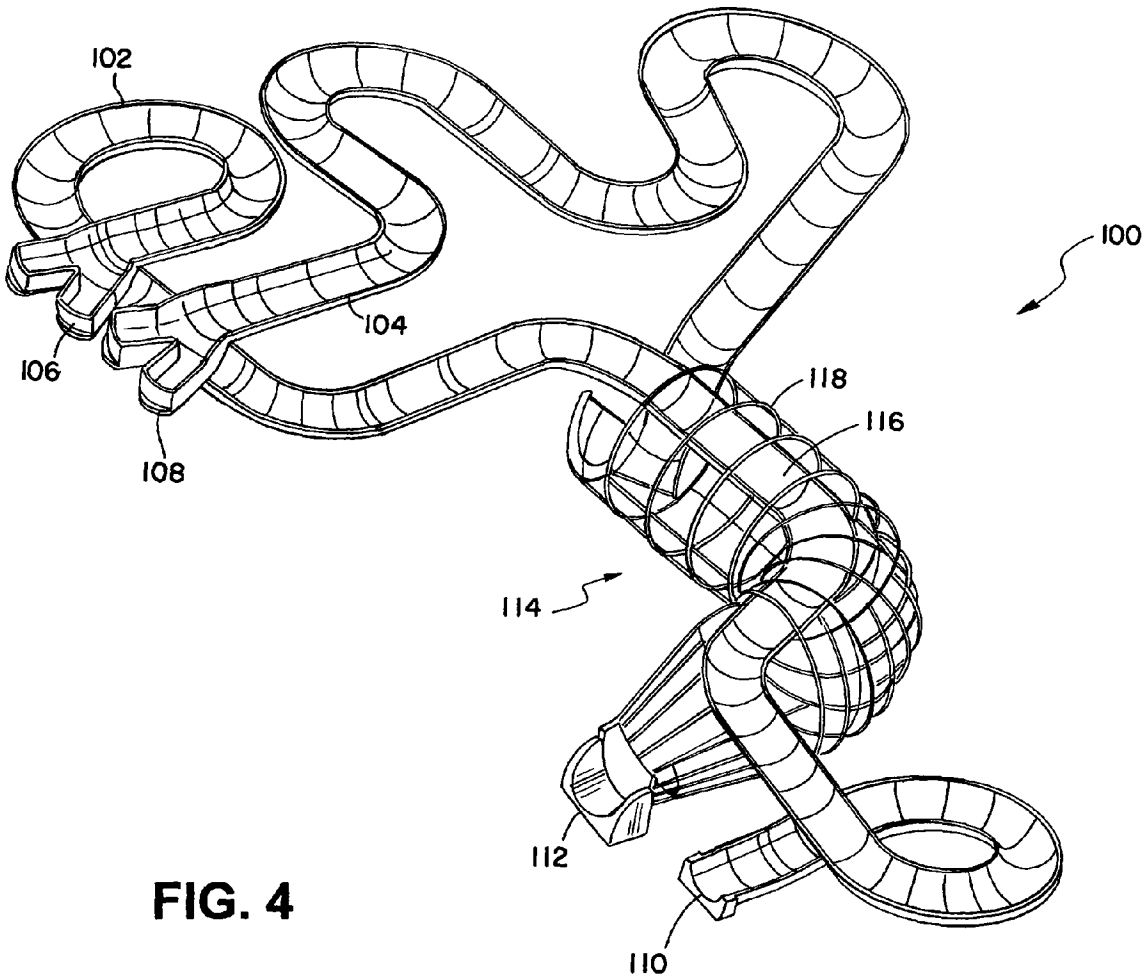
FIG. 4 is a schematic diagram of a water ride attraction according to an embodiment of the present invention.
Figure 5:
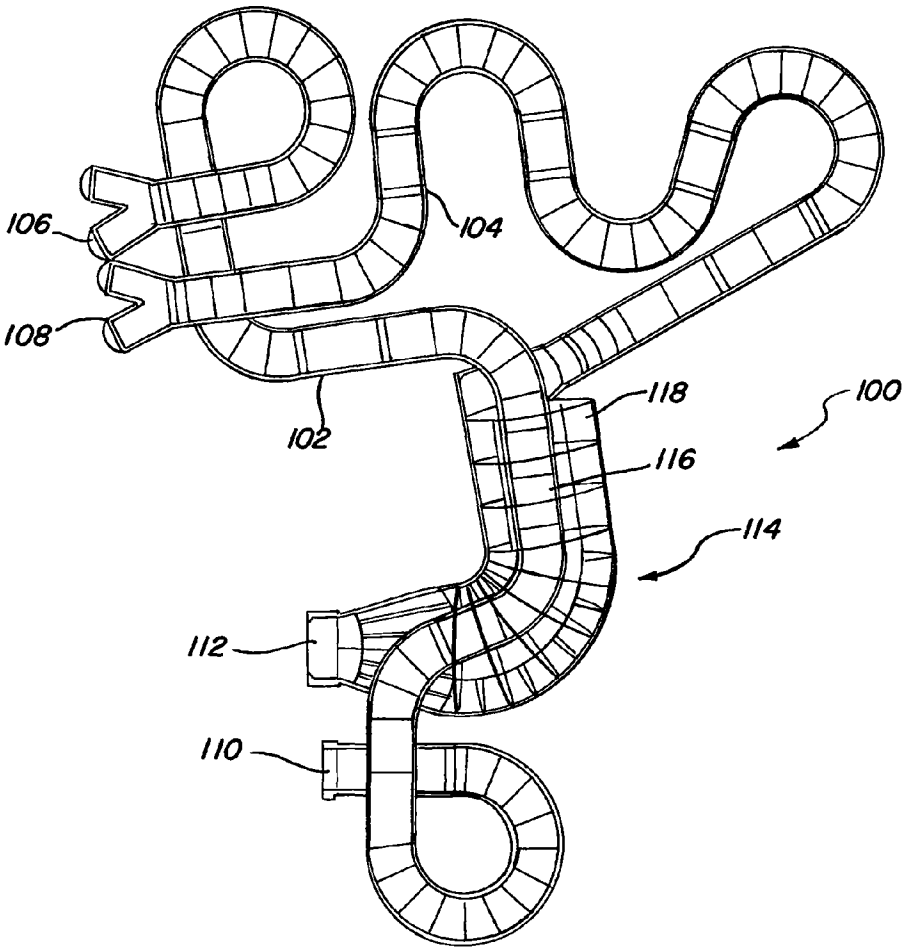
FIG. 5 is a schematic diagram of a water ride attraction according to an embodiment of the present invention.

As seen in FIG. 1, FIG. 2, FIG. 3, FIG. 4, and/or FIG. 5, the present invention can include, for example, a water ride attraction 100. The water ride attraction can include, for example, a flume ride 102 and a flume ride 104. The flume ride 102 and the flume ride 104 each include, for example, an entrance section, such as an entrance section 106 and an entrance section 108, respectively. The flume ride 102 and the flume ride 104 also each include, for example, an exit section, such as an exit section 110 and an exit section 112, respectively. Thus, a user will enter the flume ride 102 through the entrance section 106 and exit the flume ride 102 through the exit section 110, while the user will enter the flume ride 104 through the entrance section 108 and exit the flume ride 104 through the exit section 112. The exit section 110 and/or the exit section 112 can feed into one or more pools allowing the user to gently splash into a body of water. In one embodiment, the flume ride 102 and the flume ride 104 can include for example, a common entrance section and/or a common exit section. In addition, the flume ride 102 and the flume ride 104 need not be the same length, but can instead, for example, have different lengths.

The flume ride 102 pass through the flume ride 104, for example, at a pass-through section 114. The pass-through section 114 includes, for example, a middle section 116 and a middle section 118. The middle section 116 is part of the flume ride 102, while the middle section 118 is part of the flume ride 104. The pass-through section 114 allows users of the flume ride 102 and the flume ride 104 to pass by each other, and possibly view each other, while remaining in the flume ride 102 or the flume ride 104, respectively. Thus, middle section 116 and/or the middle section 118 can be completely or partially formed from transparent, substantially transparent, or partially transparent material. This can allow more visual interaction between the users of the flume ride 102 and/or the flume ride 104.

Furthermore, in some embodiments, the flume ride 104 can be formed, for example, from an opaque material such that the middle section 118 is substantially dark inside. This can allow for a different feeling and can heighten the senses as users pass by each other in the dark or substantially reduced lighting. In yet another embodiment, the flume ride 104 can be formed, for example, from a translucent material such that light can enter into the middle section 118. In addition, the flume ride 102, and/or the flume ride 104 can also include various audio or visual entertainment equipments such as lights, video screens, speakers, or any other equipment that would set the mood for the riders passing through the pass-through section 114, and/or provide entertainment for the riders passing through the pass-through section 114.

This can be a thrilling experience for the users of the flume ride 102 and/or the flume ride 104. Since the users of the flume ride 102 and the flume ride 104 will remain in their respective flume rides, the user in the flume ride 102 will not enter the flume ride 104, and the user in the flume ride 104 will not enter the flume ride 102. In addition, the flume 102 can be partially or wholly within the flume ride 104. However in one embodiment, the flume ride 102 can intersect, for example, the flume ride 104. In another embodiment, the flume ride 102 can be connected to, for example, the flume ride 104. In additional, multiple flumes can pass through one another, connect with one or another, and/or intersect one or another.

Figure 6:
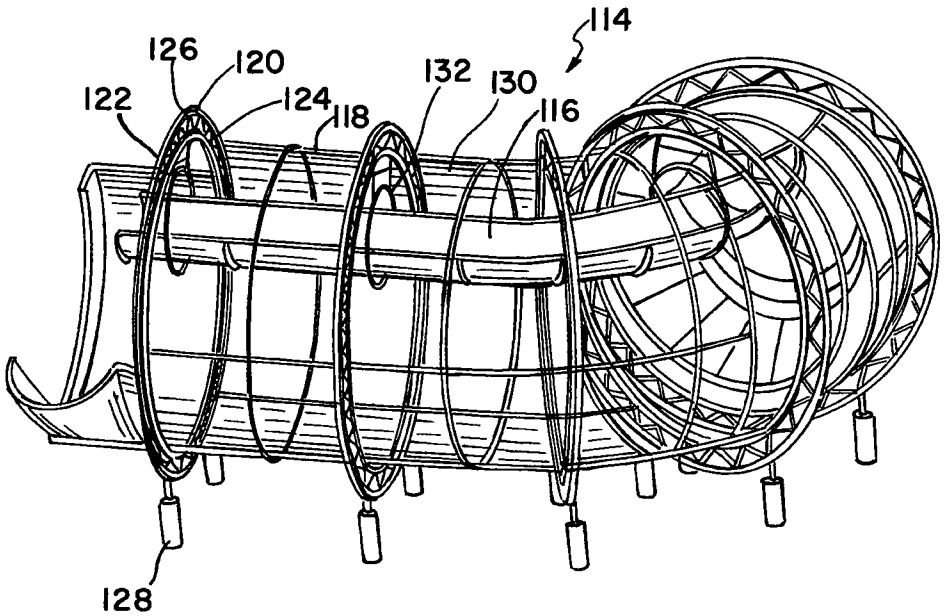
FIG. 6 is a schematic diagram of a pass-through section in a water ride attraction according to an embodiment of the present invention.
Figure 7:
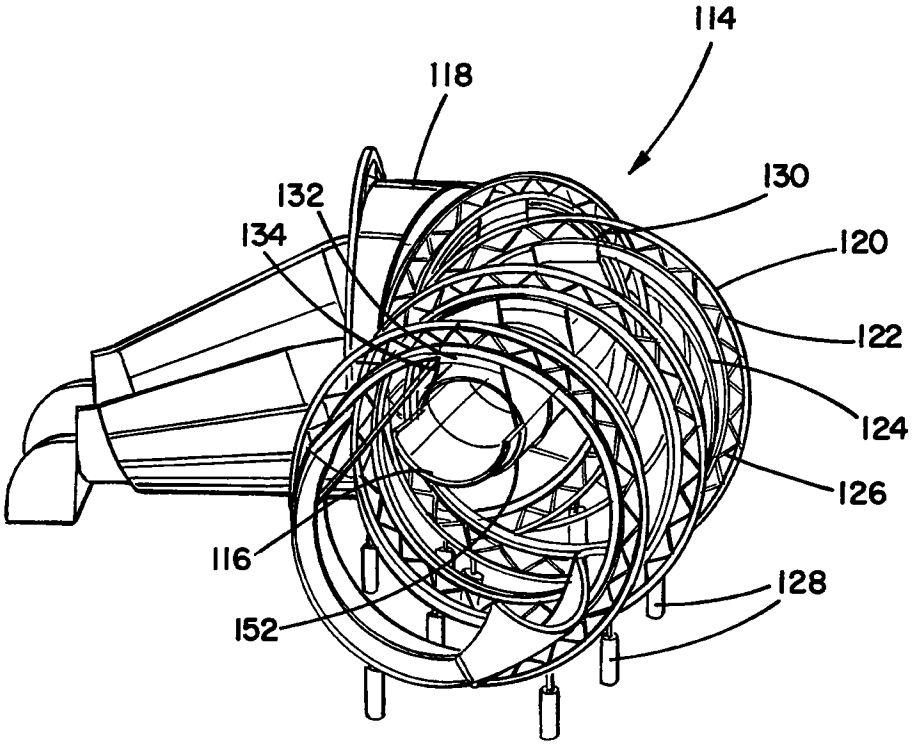
FIG. 7 is a schematic diagram of a pass-through section in a water ride attraction according to an embodiment of the present invention.
Figure 8:
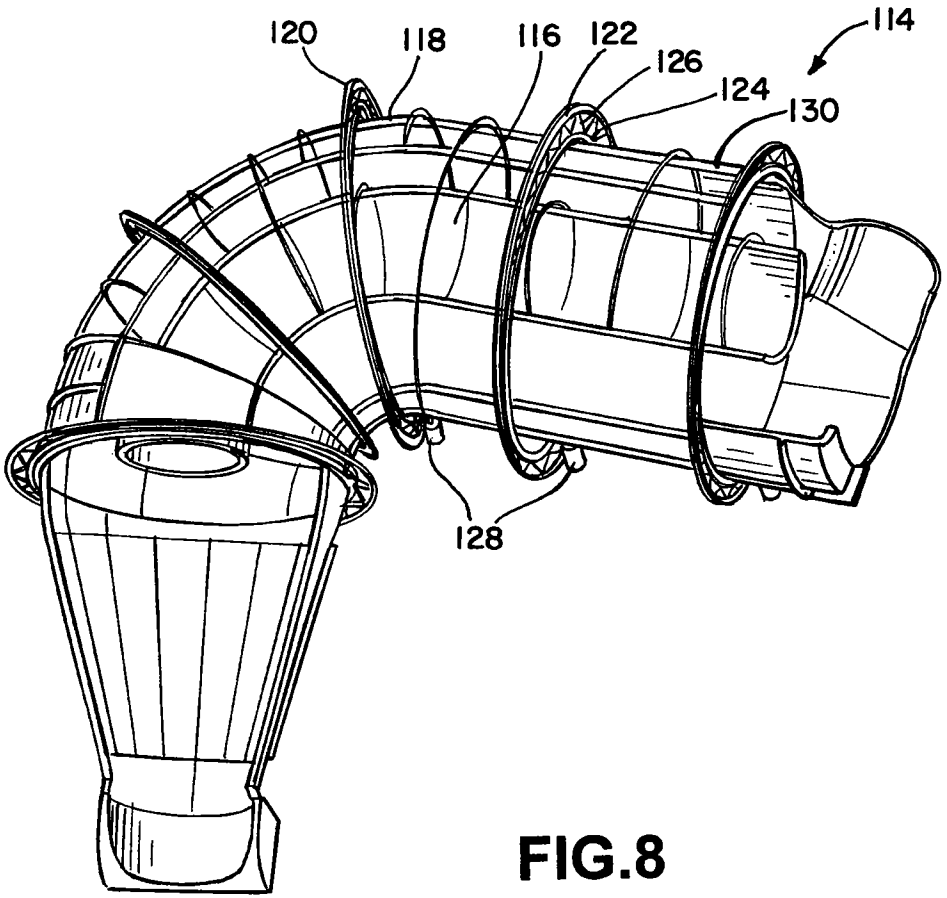
FIG. 8 is schematic diagram of a pass-through section in a water ride attraction according to an embodiment of the present invention.

The pass-through section 114 can be seen in more detail, for example, in FIG. 6, FIG. 7, and/or FIG. 8. As can be seen in FIG. 6, FIG. 7, and/or FIG. 8, the middle section 116 of the flume ride 102 pass through the middle section 118 of the flume ride 104. As can be seen, the middle section 118 is larger than the middle section 116 to allow the middle section 116 to pass through the middle section 118. Thus, the middle section 116 is contained within the middle section 118. The user for the flume ride 104 traverses on the middle section 118, while the user for the flume ride 102 traverses on the middle section 116.

The middle section 118 includes, for example, tube sections 130. A ring section 120 is connected to every other tube section 130. The ring section 120 can include, for example, an outer ring 122, an inner ring 126, a bridge 124, and support units 128. The bridge 124 can connect, for example, the outer ring 122 to the inner ring 126. The support units 128 provide support for the ring section 128 and can also, for example, anchor the ring section 128 to the ground. In general, the ring section 120 provides support for the middle section 118, and/or the pass-through section 114.

The ring section 120 can also provide support for the middle section 116 by being attached, for example, to the middle section 116 as shown in FIG. 7. In FIG. 7, the ring section 120 is attached to a plate 132. The plate 132 can be attached directly to the ring section 120 through, for example, a section which has been cut out in the middle section 118. This allows the plate 132 to traverse from an exterior of the middle section 118 to an interior of the middle section 118. The plate 132 is attached through cables 134 to a pipe 152. The pipe 152 can be hollow or solid. The pipe 152 can be bent to substantially conform, to a shape of the middle section 116, which is located inside the middle section 118. In one embodiment, the pipe 152 can be connected to the middle section 116.

Figure 9:
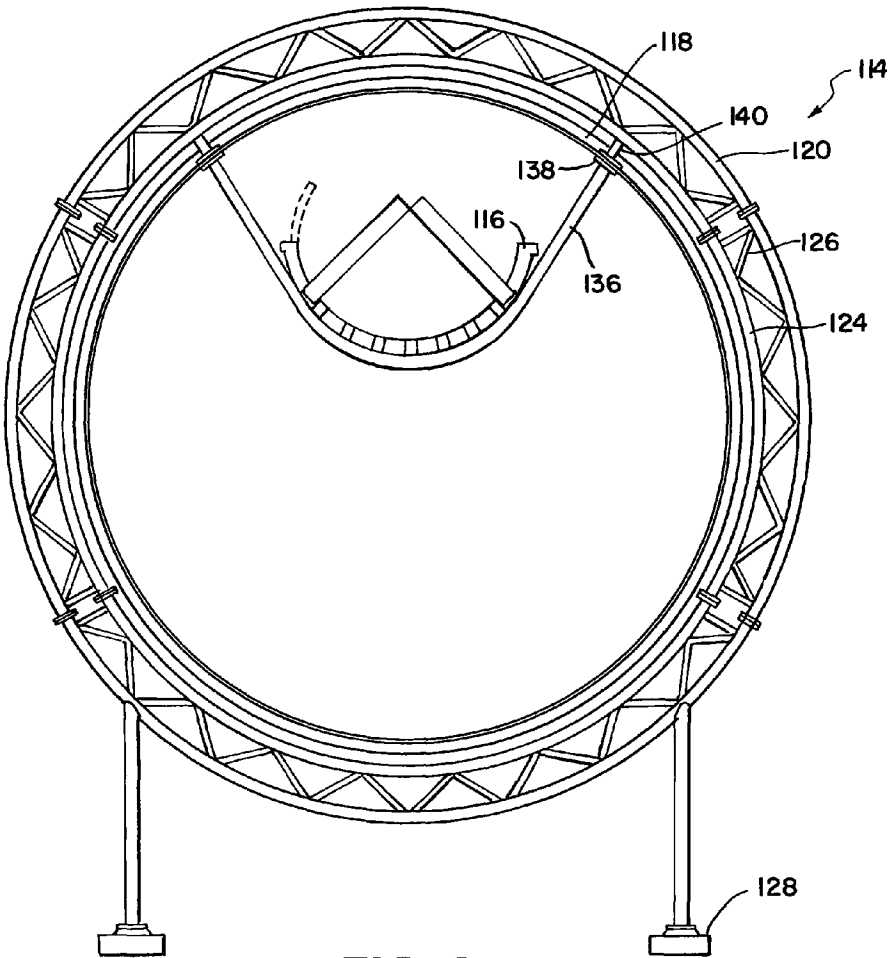
FIG. 9 is schematic diagram of a pass-through section in a water ride attraction according to an embodiment of the present invention.

FIG. 9 depicts an embodiment of the pass-through section 114. As can be seen in FIG. 9, the middle section 116 is supported by a pipe 136. In one embodiment, the pipe 136 can be attached to the middle section 116. The pipe 136 can be conformed, for example, to a shape of the middle section 116. The pipe 136 can be hollow or filled. The pipe 136 is connected to a connection unit 138. The connection unit 138 provides a connection between the middle section 116 and the ring section 120.

Figure 10:
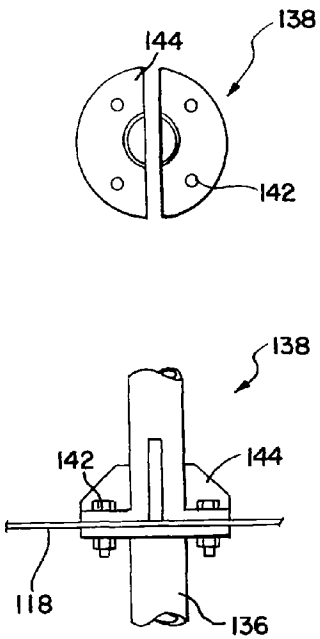
FIG. 10 is schematic diagram of a connection unit in a pass-through section of a water ride attraction according to an embodiment of the present invention.

The connection unit 138 can be seen, for example, in FIG. 10. In the connection unit 138, the pipe 136 is connected to a pipe 140. The pipe 140 is connected on one end to the pipe 136 and on another end to the ring section 120. The pipe 140 and the pipe 136 sandwich the middle section 118 and are attached to each other through connection plates 144 and fasteners 142. Thus, in FIG. 9 and FIG. 10, the ring section 120 provides support to the middle section 116 in addition to the middle section 118 using, for example, the pipe 136, the pipe 140, and/or the connection unit 138. In FIG. 9, two connection units 138 are used to connect the pipe 136 to the ring section 120 and to support the middle section 116.

Figure 12:
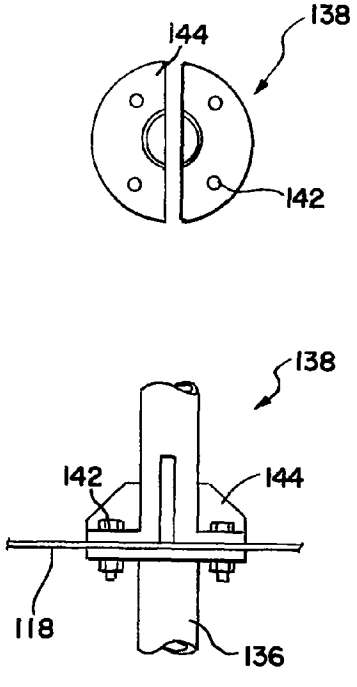
FIG. 12 is schematic diagram of a connection unit in a pass-through section of a water ride attraction according to an embodiment of the present invention.
Figure 11:
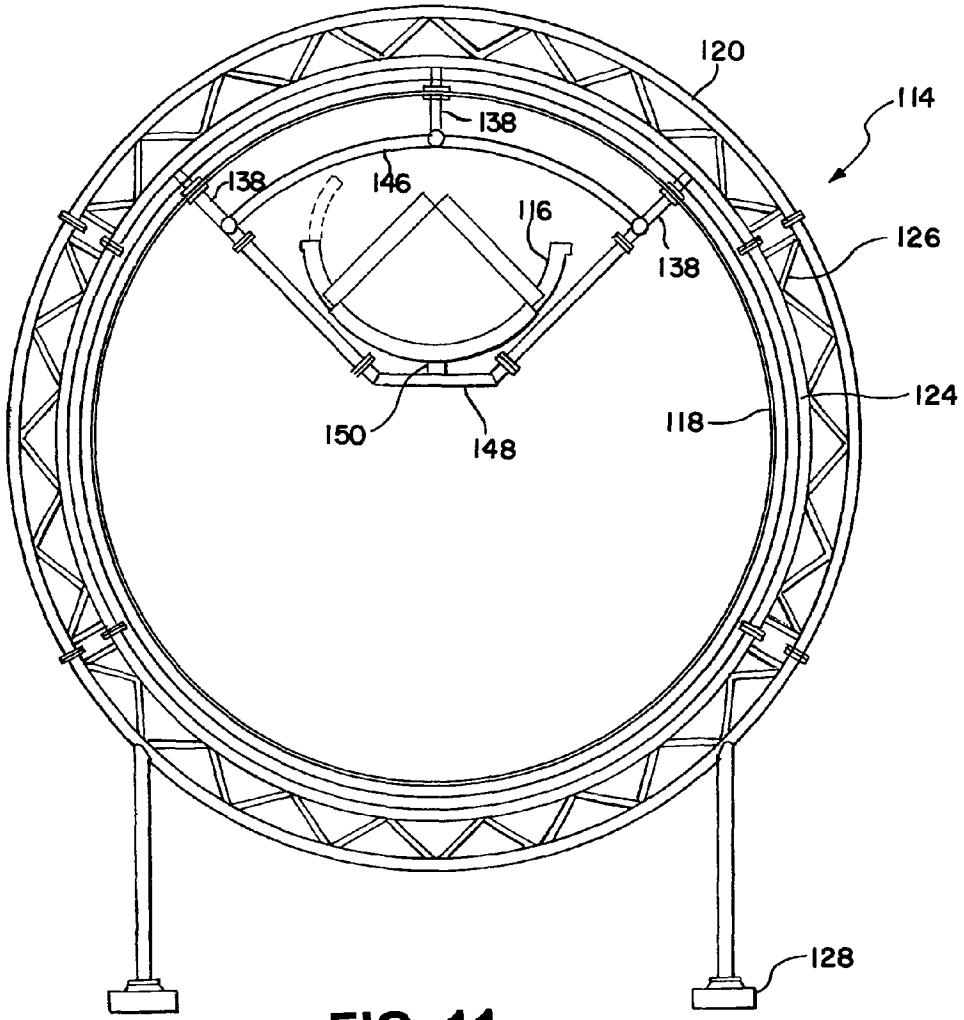
FIG. 11 is schematic diagram of a pass-through section in a water ride attraction according to an embodiment of the present invention.

FIG. 11 depicts an embodiment of the pass-through section 114. As can be seen in FIG. 11, the middle section 116 is attached to the pipe 136 using a support section 150. In addition, instead of being curved to closely approximately the shape of the middle section 116, the middle section 116 includes a flat section 148. The flat section 148 is connected to the support section 150. Furthermore, instead of two connection units 138, three connection units 138 are used to connect the pipe 136 to the ring section 120 and to support the middle section 116. In one embodiment, a curved section 146 is connected to the pipe 136 and/or the connection units 138. The connection unit 138 can also be seen, for example, in FIG. 12.

Although several support structures are disclosed to support the middle section 116, other types of support structures may be used, which can control a swinging of the middle section 116. This can include, for example, cloth material, soft material, rigid material, and/or any other types of materials which can control a swinging of the middle section 116. In one embodiment, a more rigid material can reduce a swinging of the middle section 116.

In addition, other types of support structures may be used, which allows the middle section 116 to be supported by the ring section 120. This can reduce an amount of stress on the middle section 118, allowing the middle section 118 to be built from a variety of materials. Also, the ring section 120 can increase an amount of support provided to the middle section 116 without substantially increasing an amount of materials or space needed.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A water ride attraction comprising:

a first flume ride defining a first slide path for a rider; and a second flume ride defining a second slide path for a rider, wherein the second flume ride passes through the first flume ride at a pass-through section that extends along at least a portion of the first slide path of the first flume ride, and the second flume ride is located within the first flume ride at the pass-through section.

2. The water ride attraction of claim 1 wherein the first flume ride includes a first middle section, and the second flume ride includes a second middle section.

3. The water ride attraction of claim 2 wherein the first middle section and the second middle section form the pass-through section.

4. The water ride attraction of claim 2 wherein the second middle section is located within the first middle section.

5. The water ride attraction of claim 2 wherein the first middle section includes a ring section and support units, wherein the ring section and the support units cooperate to support the first middle section.

6. The water ride attraction of claim 5 wherein the second middle section is connected to the ring section.

7. The water ride attraction of claim 2 further comprising a pipe located in the first middle section and connected to the second flume ride; and a connection unit located in the first middle section connecting the pipe to the first flume ride.

8. The water ride attraction of claim 2 further comprising a flat section located in the first middle section and connected to the second flume ride;

a pipe located in the first middle section and connected to the flat section; and a connection unit located in the first middle section connecting the pipe to the first flume ride.

9. The water ride attraction of claim 2 wherein the first middle section or the second middle section is formed from a substantially transparent material.

10. The water ride attraction of claim 2 wherein the second middle section is formed from a substantially transparent material.

11. The water ride attraction of claim 1 wherein the first slide path is substantially parallel to the second slide path at the pass-through section.

12. A water ride attraction comprising:

a first flume ride including a first middle section, the first middle section including a ring section and at least one support unit, wherein the ring section and the at least one support unit cooperate to support the first middle section; and a second flume ride including a second middle section located within the first middle section, wherein the first middle section and the second middle section form a pass-through section, and the second flume ride passes through the first flume ride at the pass-through section.

13. The water ride attraction of claim 12 wherein the second middle section is connected to the ring section.

14. The water ride attraction of claim 12 further comprising a pipe located in the first middle section and connected to the second flume ride; and a connection unit located in the first middle section connecting the pipe to the first flume ride.

15. The water ride attraction of claim 12 further comprising a flat section located in the first middle section and connected to the second flume ride; a pipe located in the first middle section and connected to the flat section; and a connection unit located in the first middle section connecting the pipe to the first flume ride.

16. The water ride attraction of claim 12 wherein the first middle section is formed from a substantially transparent material.

17. A water ride attraction comprising:

a first flume ride including a first middle section formed from a substantially transparent material, the first middle section having a ring section and support units, wherein the ring section and the support units cooperate to support the first middle section; and a second flume ride including a second middle section formed from the substantially transparent material, and located within the first middle section, wherein the first middle section and the second middle section form a pass-through section, and the second flume ride passes through the first flume ride at the pass-through section.

18. The water ride attraction of claim 17 further comprising a pipe located in the first middle section and connected to the second flume ride; and a connection unit located in the first middle section connecting the pipe to the first flume ride.

19. The water ride attraction of claim 17 further comprising a flat section located in the first middle section and connected to the second flume ride; a pipe located in the first middle section and connected to the flat section; and a connection unit located in the first middle section connecting the pipe to the first flume ride.

20. A water ride attraction comprising:

a first flume ride including a first middle section having a ring section and support units, wherein the ring section and the support units cooperate to support the first middle section; and a second flume ride including a second middle section, wherein the second flume ride passes through the first flume ride at a pass-through section, and the second flume ride is located within the first flume ride at the pass-through section.

21. The water ride attraction of claim 20 wherein the second middle section is connected to the ring section.

22. A water ride attraction comprising:

a first flume ride including a first middle section;

a second flume ride including a second middle section, wherein the second flume ride passes through the first flume ride at a pass-through section, and the second flume ride is located within the first flume ride at the pass-through section;

a pipe located in the first middle section and connected to the second flume ride; and a connection unit located in the first middle section connecting the pipe to the first flume ride.

23. A water ride attraction comprising:

a first flume ride including a first middle section;

a second flume ride including a second middle section, wherein the second flume ride passes through the first flume ride at a pass-through section, and the second flume ride is located within the first flume ride at the pass-through section;

a flat section located in the first middle section and connected to the second flume ride;

a pipe located in the first middle section and connected to the flat section; and a connection unit located in the first middle section connecting the pipe to the first flume ride.

* * * * *